US007119781B2

(12) United States Patent
Yu

(10) Patent No.: US 7,119,781 B2
(45) Date of Patent: Oct. 10, 2006

(54) ACTIVE MATRIX DISPLAY PRECHARGING CIRCUIT AND METHOD THEREOF

(75) Inventor: Jian-Shen Yu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 493 days.

(21) Appl. No.: 10/760,953

(22) Filed: Jan. 20, 2004

(65) Prior Publication Data

US 2004/0145554 A1 Jul. 29, 2004

(30) Foreign Application Priority Data

Jan. 24, 2003 (TW) ..... 92101570 A

(51) Int. Cl.
*G09G 3/36* (2006.01)

(52) U.S. Cl. ..... 345/98; 345/100; 345/211

(58) Field of Classification Search ..... 345/87–89, 345/96, 98, 99, 100, 204, 211, 212, 55, 76, 345/82; 315/169.1
See application file for complete search history.

(56) References Cited

U.S. PATENT DOCUMENTS 5,686,936 A * 11/1997 Maekawa et al. ..... 345/100
6,034,549 A * 3/2000 Matsumoto et al. ..... 326/68
6,181,314 B1 * 1/2001 Nakajima et al. ..... 345/100
6,236,256 B1 * 5/2001 Brownlow et al. ..... 327/333
6,369,786 B1 * 4/2002 Suzuki ..... 345/77
6,593,920 B1 * 7/2003 Okumura et al. ..... 345/204
7,006,068 B1 * 2/2006 Haga ..... 345/98
2002/0021606 A1 * 2/2002 Tsuchi ..... 365/203
2006/0152461 A1 * 7/2006 Kida et al. ..... 345/98

* cited by examiner

*Primary Examiner*—Xiao Wu
(74) *Attorney, Agent, or Firm*—Thomas, Kayden, Horstemeyer & Risley

(57) ABSTRACT

A precharge system for active matrix display devices having data and scan lines, pixels, and first and second voltage sources. The precharge system comprises a precharge circuit having first transistors, with gate electrode and drain electrode connected to function as a diode, of which a first terminal is coupled to the first voltage source, a second transistor of which a first terminal is coupled to the second terminals of the first transistors, a second terminal is coupled to the data lines, and a control terminal receives a positive precharge signal, third transistors, connected to function as a diode, of which a first terminal is coupled to the second voltage source, and a fourth transistor of which a first terminal is coupled to the second terminals of the third transistors, a second terminal is coupled to the corresponding data lines, and a control terminal receives a negative precharge signal.

13 Claims, 11 Drawing Sheets

ACTIVE MATRIX DISPLAY PRECHARGING CIRCUIT AND METHOD THEREOF

BACKGROUND OF THE INVENTION

1. Field of the Invention

The present invention relates to a precharge system for an active matrix display device, which is integrated on the display peripheral area and comprises low temperature polysilicon (LTPS) thin film transistors. Before data is written onto a data line, a precharge voltage is input into the data line to raise voltage to a predetermined level, thus accelerating the reaction of a liquid crystal display (LCD) unit.

2. Description of the Related Art

FIG. 1 is a schematic diagram showing a conventional LCD device with integrated driving circuits on display peripheral area. FIG. 2 is a plot showing a clock timing of the conventional LCD device. As shown in FIG. 1, a vertical driving circuit V driver 1 synchronizes a vertical start signal VST, with a vertical clock signal VCK, to provide vertical scan signals $\Phi_{V1}$, $\Phi_{V2}$, $\Phi_{V3}$, $\Phi_{VM}$ for selecting gate lines X. During a frame, a horizontal driving circuit H driver 2 provides each signal line Y with a video signal VSIG sequentially. Therefore, video data is written into the LCD device by a dot matrix scanning method. A terminal of each signal line Y has a horizontal switch (HSW1, HSW2, HSW3, . . . , HSWN) and is thereby coupled to a video signal line 3. The horizontal driving circuit H driver 2 synchronizes a horizontal start signal HST, according to a horizontal clock signal HCK, to provide sample impulse signals $\Phi_{H1}$, $\Phi_{H2}$, $\Phi_{H3}$, . . . , $\Phi_{HN}$ for controlling the corresponding horizontal switches to sample and retain video signals from the signal lines Y.

When sampling the video signal VSIG, a precharge circuit 4 provides each signal line Y with a precharge signal VPS. The precharge circuit 4 is coupled to a terminal of each signal line Y through precharge switches PSW1, PSW2, PSW3, and PSW4. A control circuit P driver 5 controls the precharge switches PSW to turn on or off and provides each signal line Y with the precharge signal VPS. The control circuit D driver 5 synchronizes a precharge start signal PST, with a precharge clock signal PCK, to provide the precharge switches PSW with precharge sample impulse signals $\Phi_{P1}$, $\Phi_{P2}$, $\Phi_{P3}$, . . . , $\Phi_{PN}$.

The conventional LCD device requires an additional precharge signal VPS to provide voltage required by a gray scale LCD pixel on the signal line.

SUMMARY OF THE INVENTION

Accordingly, the present invention provides a precharge system on display peripheral area, appropriate for an active matrix display device having a plurality of data lines, a plurality of scan lines, a plurality of pixels, a first voltage source, and a second voltage source, comprising a precharge circuit having a plurality of first transistors, with gate electrode and drain electrode connected together to function as a diode, of which a first terminal is coupled to the first voltage source, a second transistor of which a first terminal is coupled to the second terminals of the first transistors, of which a second terminal is coupled to the data lines, and a control terminal receives a positive precharge signal, a plurality of third transistors, with gate electrode and drain electrode connected together to function as a diode, of which a first terminal is coupled to the second voltage source, and a fourth transistor of which a first terminal is coupled to the second terminals of the third transistors, of which a second terminal is coupled to the corresponding data lines, and a control terminal receives a negative precharge signal.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

First Embodiment

Figure 1:
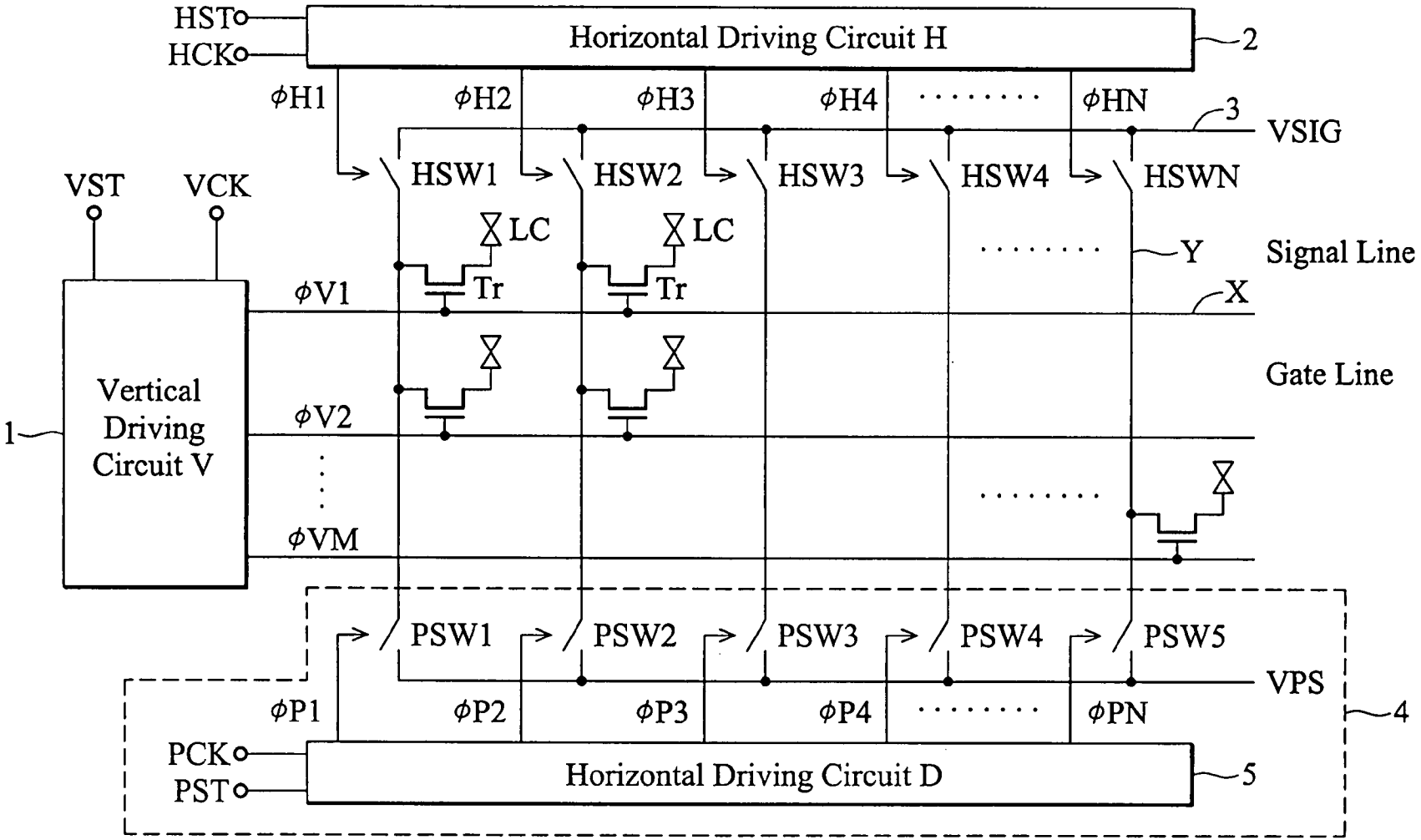
FIG. 1 (RELATED ART)
FIG. 1 is a schematic diagram showing a conventional LCD device.
Figure 2:
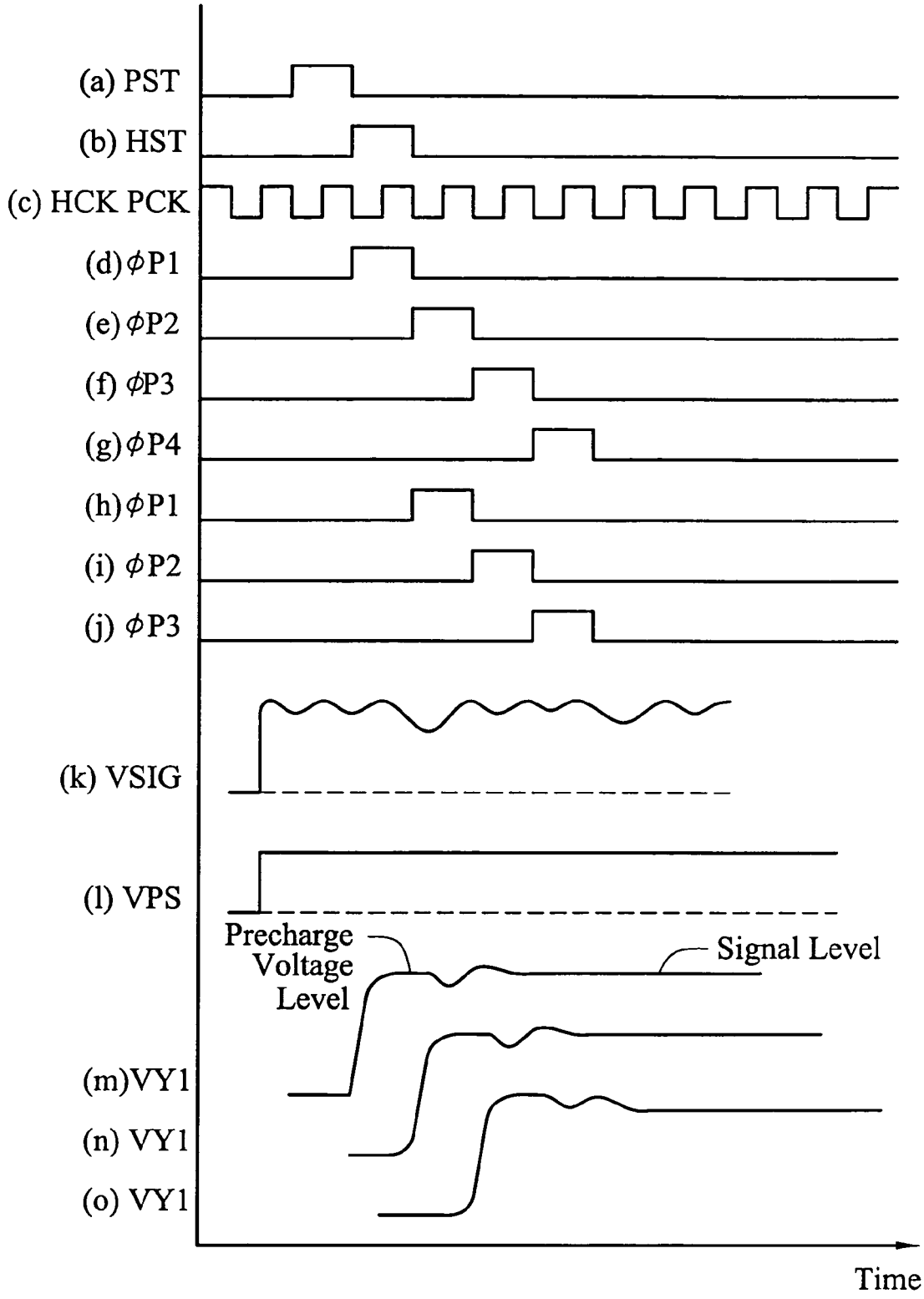
FIG. 2 (RELATED ART)
FIG. 2 is a plot showing a timing chart of the conventional LCD device.
Figure 3:
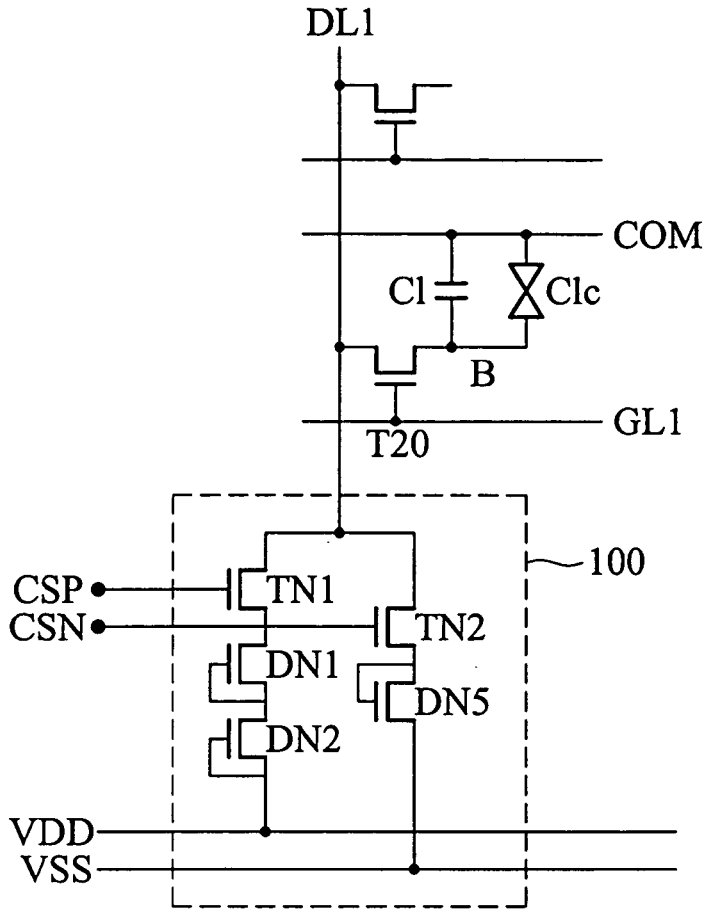
FIG. 3 is a schematic diagram showing a precharge circuit of the first embodiment of the present invention.

FIG. 3 is a schematic diagram showing a precharge circuit of the first embodiment of the present invention. As shown in FIG. 3, the precharge circuit 100 comprises thin film transistors TN1, TN2, DN1, DN2, and DN5, wherein gate electrode and drain electrode of DN1, DN2, and DN5 are connected together to function as a diode. A high voltage source VDD is coupled to a data line DL1 through the thin film transistors DN1, DN2, and TN1. A low voltage source VSS is coupled to a data line DL1 through the thin film transistors DN5 and TN2. A gate terminal of the thin film transistor TN1 is controlled by a positive precharge signal CSP, while a gate terminal of the thin film transistor TN2 is controlled by a negative precharge signal CSN.

The data line DL1 is coupled to an LCD unit Clc and a holdup capacitor C1 through a thin film transistor T20, which is controlled by a scan signal on the scan line GL1.

As an example, suppose the high voltage source VDD has a voltage of 10V, the low voltage source has a voltage of 0V, a common voltage Vcom is 4V, and a threshold voltage of DN1, DN2, and DN5 is 2V. Therefore, a positive precharge signal voltage of 6V is determined by subtracting the threshold voltage of DN1 and DN2 from the voltage of the high voltage source VDD (10−2−2=6V). A negative precharge signal voltage of 2V is determined by adding the threshold voltage of DN5 to the voltage of the low voltage source VSS (0+2=2V). Above-mentioned positive/negative signal is reference to the common voltage Vcom.

Figure 4:
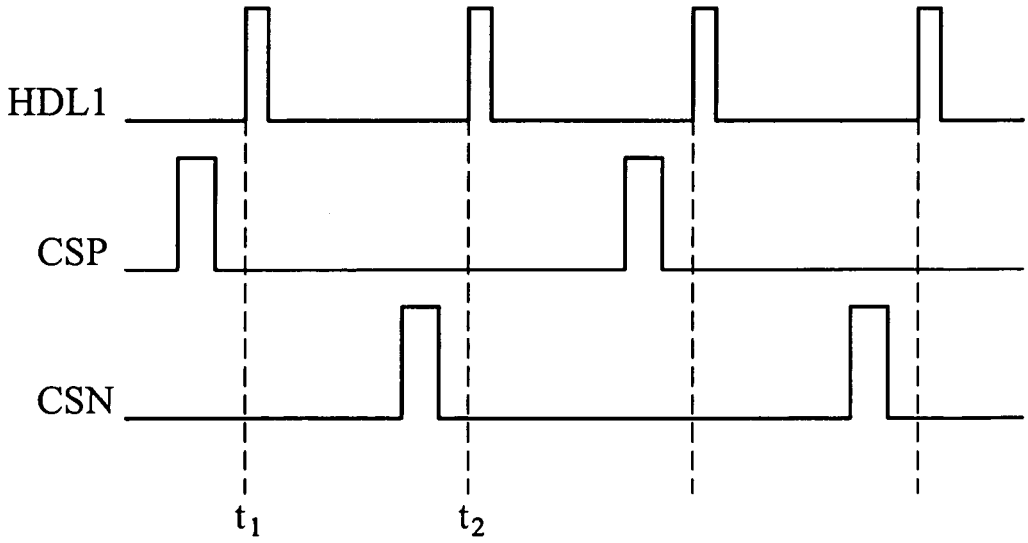
FIG. 4 is a plot showing a timing chart of the first embodiment of the present invention.

FIG. 4 is a plot showing a timing chart of the first embodiment of the present invention. HDL1 is a periodic driving pulse of the data line DL1 with a period of a horizontal-line scan time. Before time t1, at which point data is to be written to the data line DL1, the positive precharge signal CSP is at a high voltage level, such that the thin film transistor TN1 is turned on. The data line DL1 is charged to the positive precharge voltage. At time t1, data writing to data line DL1 begins. Before time t2, at which point data is to be written to the data line DL1, the negative precharge signal CSN is at a high voltage level, such that the thin film transistor TN2 is turned on. The data line DL1 is discharged to the negative precharge voltage. At time t2, data writing to data line DL1 begins. The embodiment is suitable for a driving mode of polarity reversal of pixels on adjacent rows and for a driving mode of polarity reversal of pixels within each frame.

The precharge circuit of the present invention does not require an additional AC voltage source to generate precharge voltage. The positive and negative precharge voltages can be generated by the high voltage source VDD and the low voltage source VSS of peripheral circuits. Number of the thin film transistors DN1, DN2, and DN3 determines the levels of the positive and negative precharge voltages.

Second Embodiment

Figure 5:
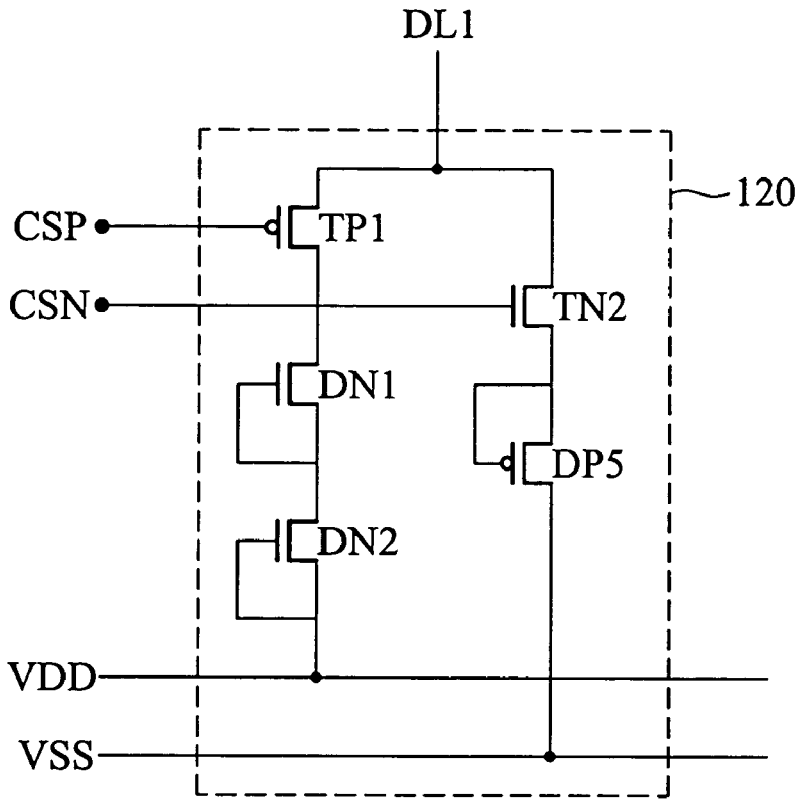
FIG. 5 is a schematic diagram showing a precharge circuit of the second embodiment of the present invention.

FIG. 5 is a schematic diagram showing a precharge circuit of the second embodiment of the present invention. As shown in FIG. 5, the precharge circuit 120 comprises thin film transistors TP1, TN2, DN1, DN2, and DP5, wherein gate electrode and drain electrode of DN1, DN2, and DP5 are connected together to function as a diode. A high voltage source VDD is coupled to a data line DL1 through the thin film transistors DN1, DN2, and TP1. A low voltage source VSS is coupled to a data line DL1 through the thin film transistors DP5 and TN2. A gate terminal of the thin film transistor TP1 is controlled by a positive precharge signal CSP, while a gate terminal of the thin film transistor TN2 is controlled by a negative precharge signal CSN.

As an example, suppose the high voltage source VDD has a voltage of 10V, the low voltage source has a voltage of 0V, a common voltage Vcom is 4V, and a threshold voltage of DN1, DN2, and DP5 is 2V. Therefore, a positive precharge signal voltage of 6V is determined by subtracting the threshold voltage of DN1 and DN2 from the voltage of the high voltage source VDD (10−2−2=6V). A negative precharge signal voltage of 2V is determined by adding the threshold voltage of DP5 to the voltage of the low voltage source VSS (0+2=2V).

Figure 6:
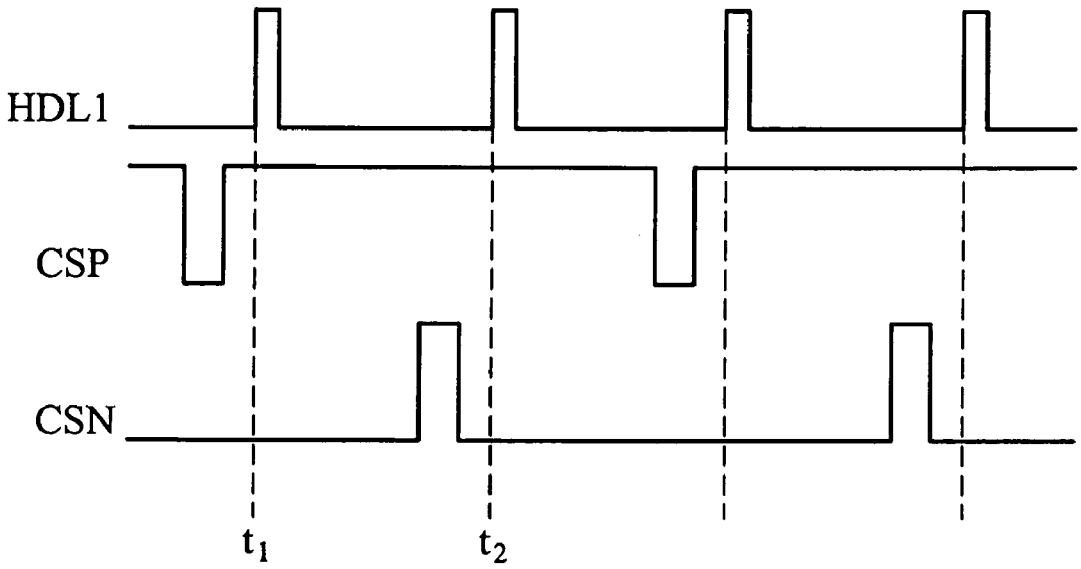
FIG. 6 is a plot showing a timing chart of the second embodiment of the present invention.

FIG. 6 is a plot showing a timing chart of the second embodiment of the present invention. HDL1 is the driving signal of the data line DL1 with a period of a horizontal-line scan time. Before time t1, at which point data is to be written to the data line DL1, the positive precharge signal CSP is at a low voltage level, such that the thin film transistor TP1 is turned on. The data line DL1 is charged to the positive precharge voltage. At time t1, data writing to data line DL1 begins. Before time t2, at which point data is to be written to the data line DL1, the negative precharge signal CSN is at a high voltage level, such that the thin film transistor TN2 is turned on. The data line DL1 is discharged to the negative precharge voltage. At time t2, data writing to data line DL1 begins.

Third Embodiment

Figure 7:
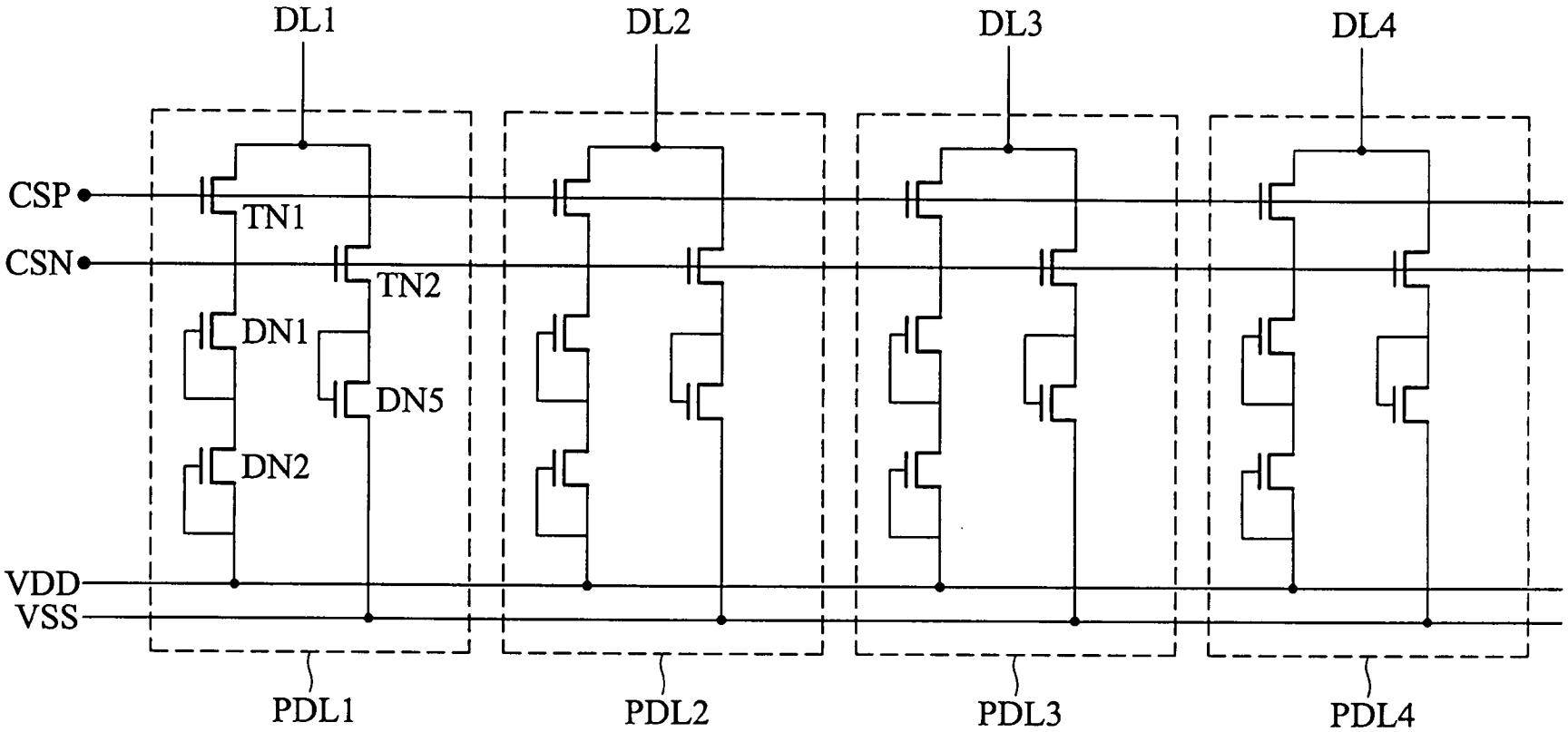
FIG. 7 is a schematic diagram showing a precharge array of the third embodiment of the present invention.

FIG. 7 is a schematic diagram showing a precharge array of the third embodiment of the present invention. As shown in FIG. 7, the precharge array comprises precharge circuits PDL1, PDL2, PDL3, and PDL4, as well as data lines DL1, DL2, DL3, and DL4. A high voltage source VDD and the low voltage source VSS are coupled to the data lines DL1, DL2, DL3, and DL4 respectively through the precharge circuits PDL1, PDL2, PDL3, and PDL4. A gate terminal of the thin film transistor TN1 is controlled by a positive precharge signal CSP, while a gate terminal of the thin film transistor TN2 is controlled by a negative precharge signal CSN.

Figure 8:
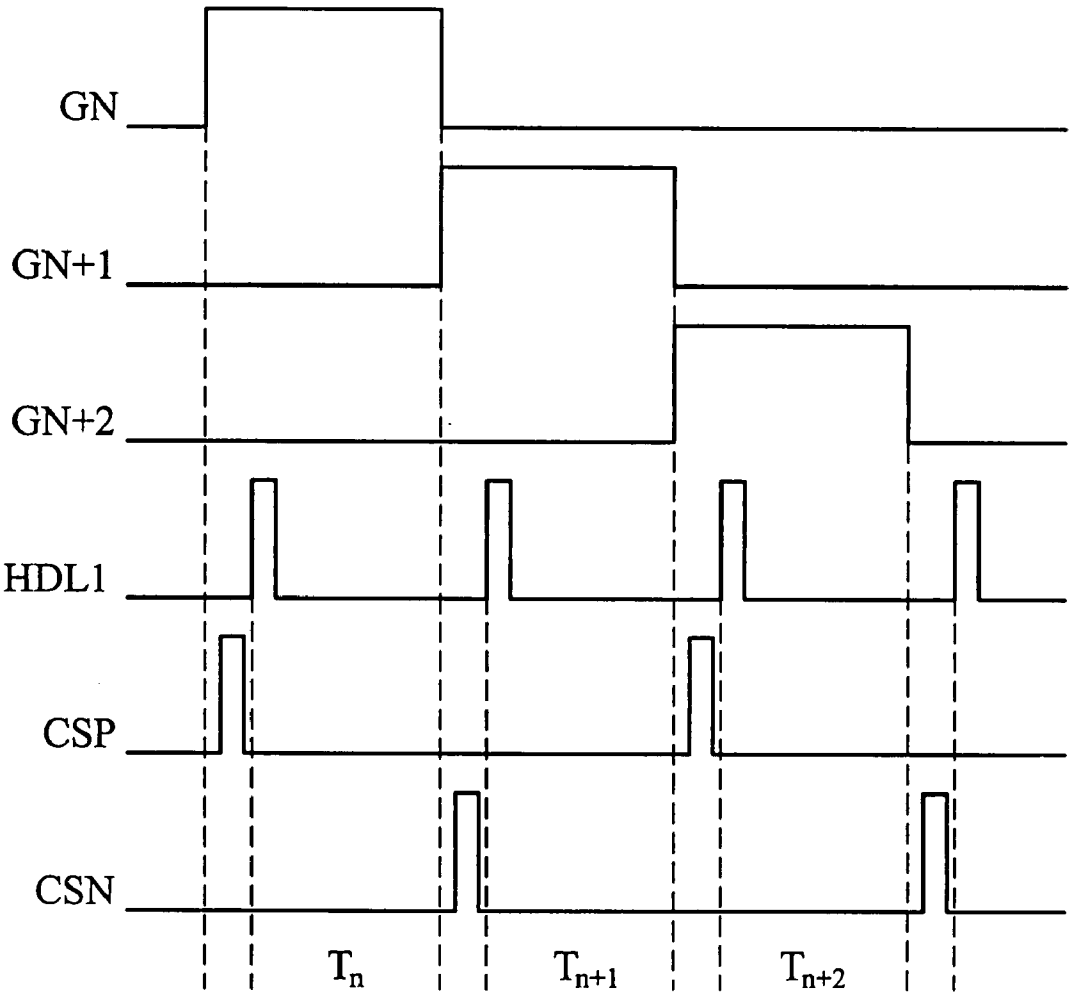
FIG. 8 is a plot showing a timing chart of the third embodiment of the present invention.

FIG. 8 is a plot showing a timing chart of the third embodiment of the present invention. GN, GN+1 and GN+2 are scan signals on scan line GLN, GLN+1 and GLN+2, respectively. Before data is written to the data lines DL1, DL2, DL3, and DL4, the positive precharge signal CSP must turn on each thin film transistor TN1 in the precharge circuits PDL1, PDL2, PDL3, and PDL4 or the negative precharge signal CSN must turn on each thin film transistor T21 in the precharge circuits PDL1, PDL2, PDL3, and PDL4, such that the data lines DL1, DL2, DL3, and DL4 are precharged to a high voltage or a low voltage.

Figure 9:
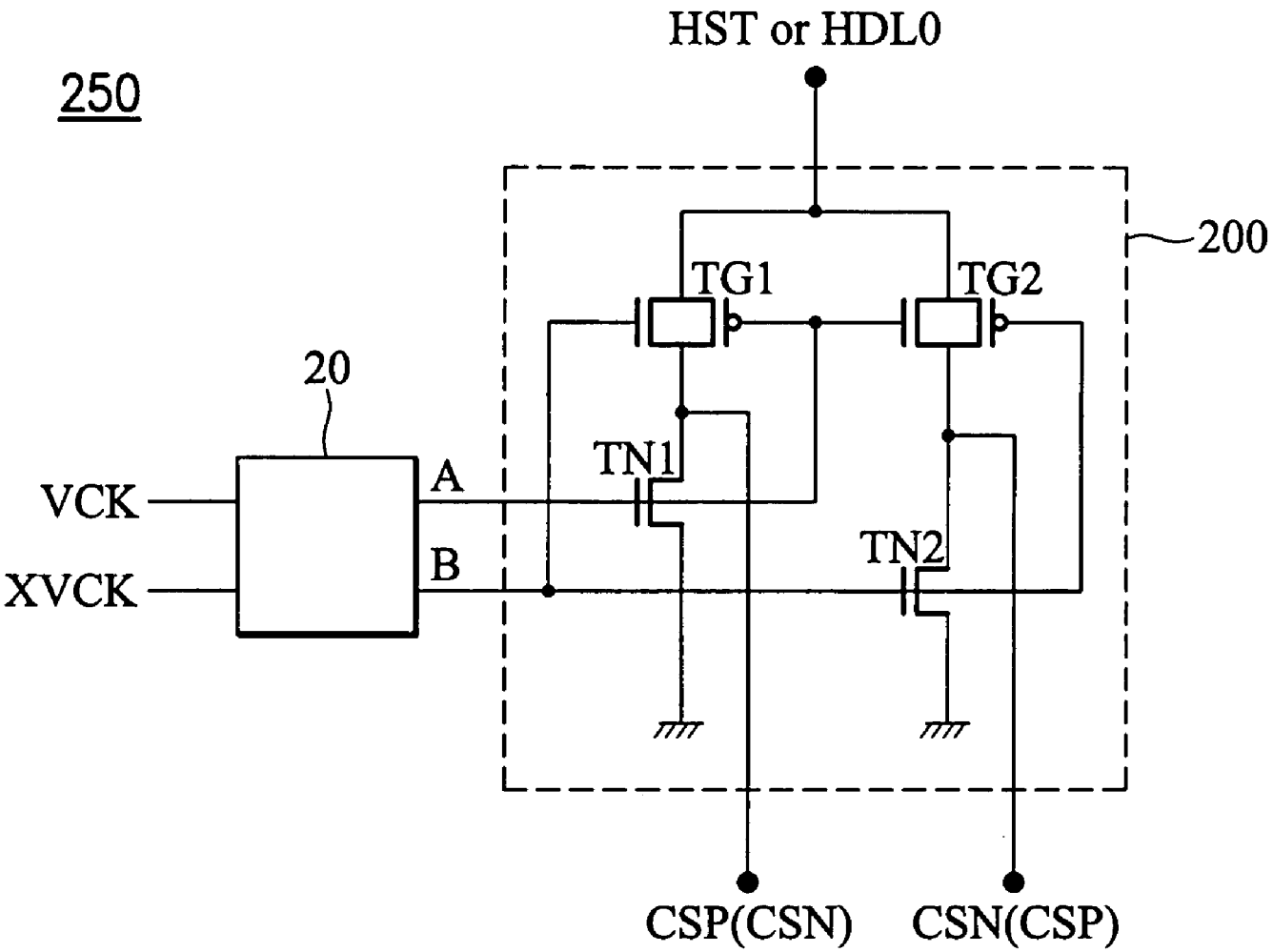
FIG. 9 is a schematic diagram showing a precharge signal generation circuit of the third embodiment of the present invention.

The precharge signals CSP and CSN can also be generated on the display peripheral area. FIG. 9 is a schematic diagram showing a precharge signal generation circuit of the third embodiment of the present invention. As shown in FIG. 9, the generation circuit 250 comprises a selection circuit 200 and a voltage level shifter 20. The selection circuit 200 comprises an input terminal, a selection terminal A, a complementary selection terminal B, a first output terminal, a second output terminal, thin film transistors TN1 and TN2, and transmission gates TG1 and TG2. The selection terminal A is coupled to a first gate terminal of the transmission gate TG1 (a gate terminal of a P-type thin film transistor), a second gate terminal of the transmission gate TG2 (a gate terminal of an N-type thin film transistor), and a gate terminal of the thin film transistor TN1. In addition, the selection terminal A is coupled to a clock signal VCK through the voltage level shifter 20. The complementary selection terminal B is coupled to a second gate terminal of the transmission gate TG1 (a gate terminal of an N-type thin film transistor), a first gate terminal of the transmission gate TG2 (a gate terminal of a P-type thin film transistor), and a gate terminal of the thin film transistor TN2. Additionally, the complementary selection terminal B is coupled to a complementary clock signal XVCK through the voltage level shifter 20. The transmission gate TG1 is coupled to the thin film transistor TN1 and outputs the positive precharge signal CSP through the first output terminal, which is the first terminal of the transmission gate TG1. The transmission gate TG2 is coupled to the thin film transistor TN2 and outputs the negative precharge signal CSN through the second output terminal, which is the first terminal of the transmission gate TG2. The second terminal of the transmission gate TG1 and that of the transmission gate TG2 are both coupled to the input terminal for receiving the horizontal start signal HST from a buffer or from a first horizontal driving signal HDL0. The generation circuit 250 is suitable for an on-glass packaging method.

Figure 10:
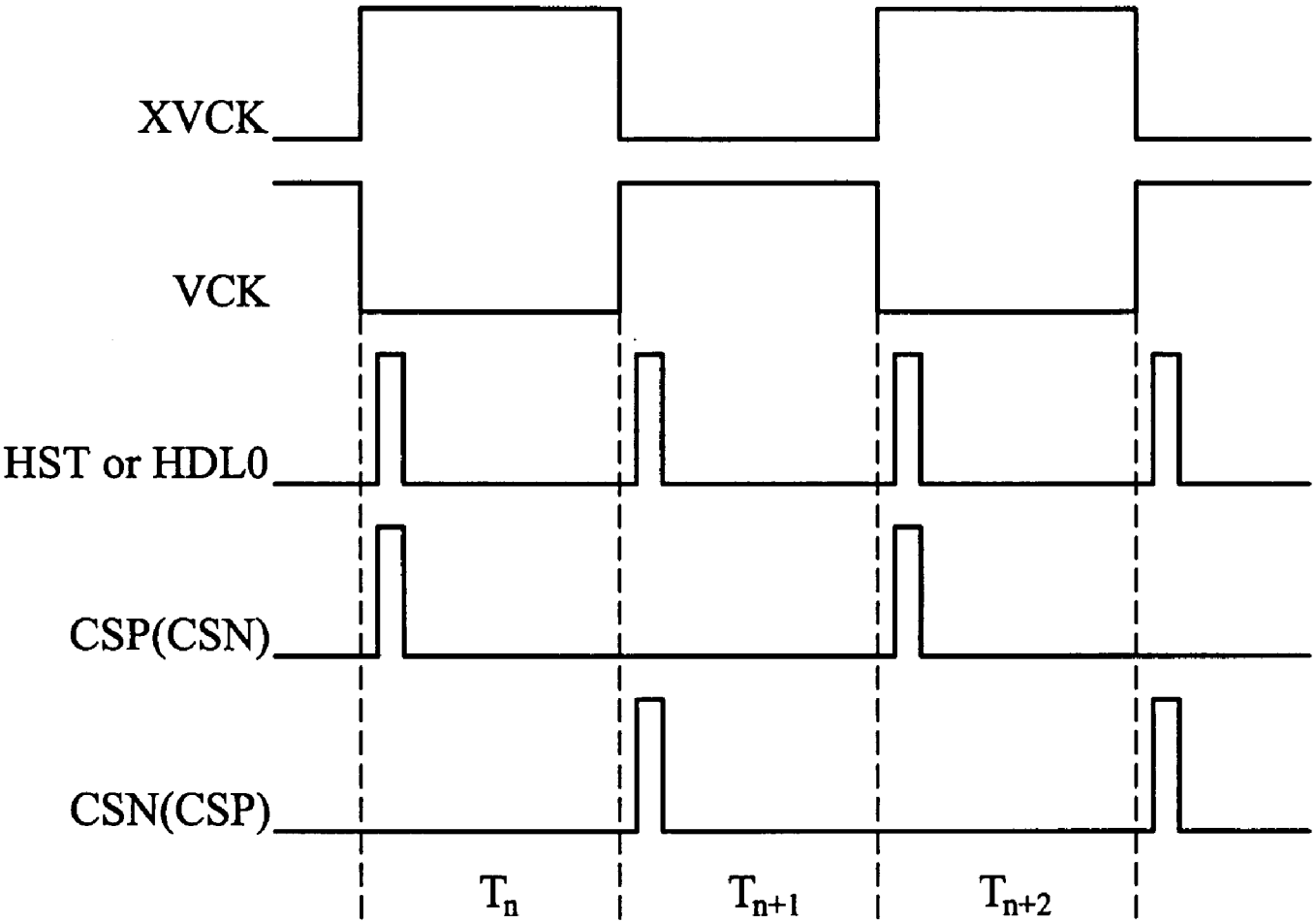
FIG. 10 is a plot showing a timing chart of the generation circuit in FIG. 9.

FIG. 10 is a plot showing a timing chart of the generation circuit in FIG. 9. During a period Tn, the clock signal VCK of a scan driver (not shown in drawings) is at a low voltage level, and the complementary clock signal of that is at a high voltage level. The transmission gate TG1 is turned on. The horizontal start signal HST or the HSR generates the positive precharge signal CSP. The transmission gate TG2 is turned off. The film transistor TN2 is turned on and coupled to a low voltage level. Therefore, the negative precharge signal CSN does not function. During a period Tn+1, the clock signal VCK is at a high voltage level, and the complementary clock signal is at a low voltage level. The transmission gate TG2 is turned on. The horizontal start signal HST or the HDL0 generates the negative precharge signal CSN. The transmission gate TG1 is turned off. The thin film transistor TN1 is turned on and coupled to a low voltage level. Therefore, the positive precharge signal CSP does not function.

Figure 11:
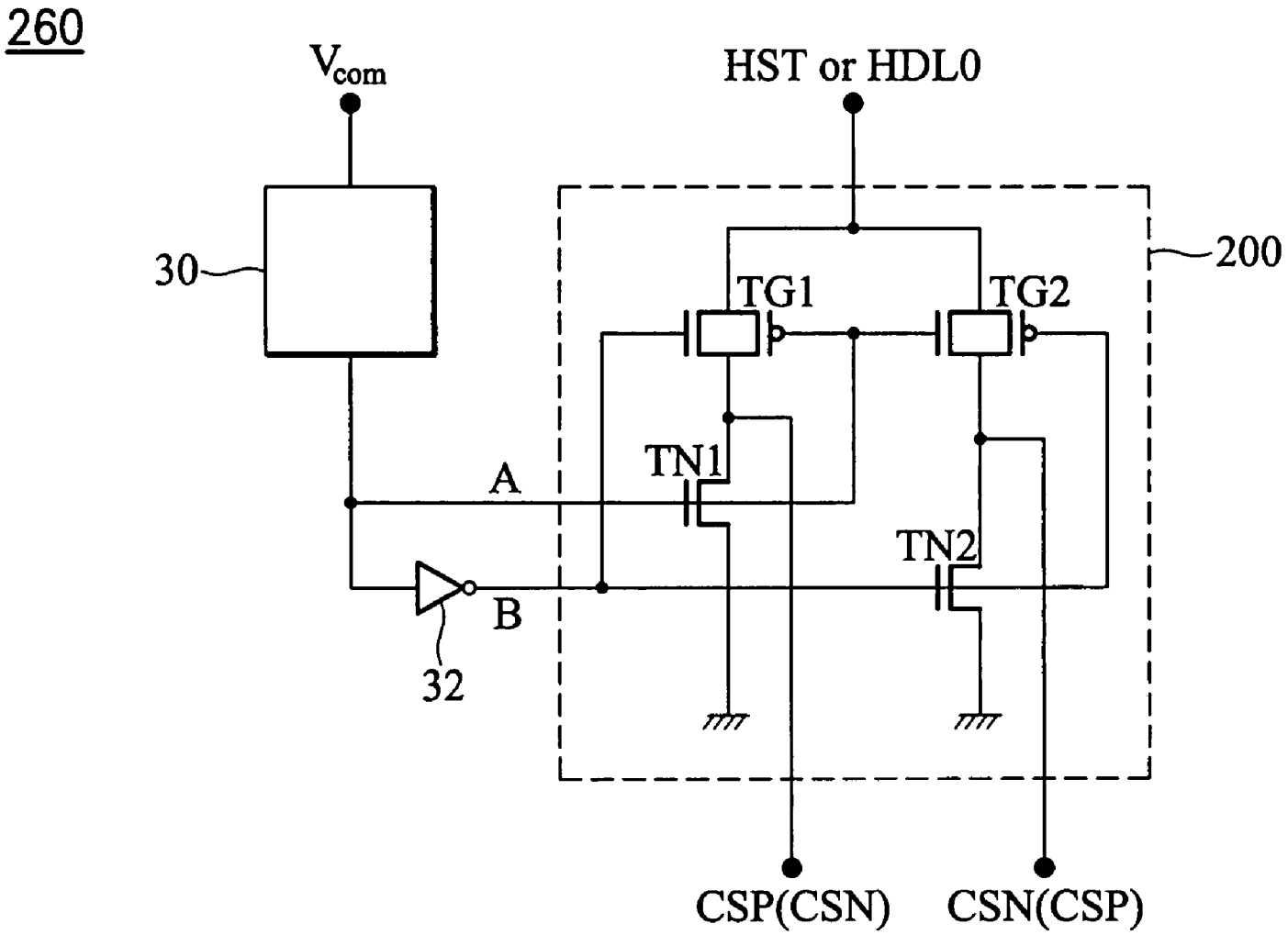
FIG. 11 is a schematic diagram showing a precharge signal generation circuit of the third embodiment of the present invention.

FIG. 11 is a schematic diagram showing another generation circuit of the third embodiment of the present invention. As shown in FIG. 11, the generation circuit 260 comprises the selection circuit 200, a level shifter 30, and an inverter 32. The selection terminal A is coupled to an output terminal of the level shifter 30. An input terminal of the inverter 32 is coupled to the output terminal of the level shifter 30. The complementary selection terminal B is coupled to an output terminal of the inverter 32. The generation circuit 260 is suitable for a chip on glass packaging method.

Figure 12:
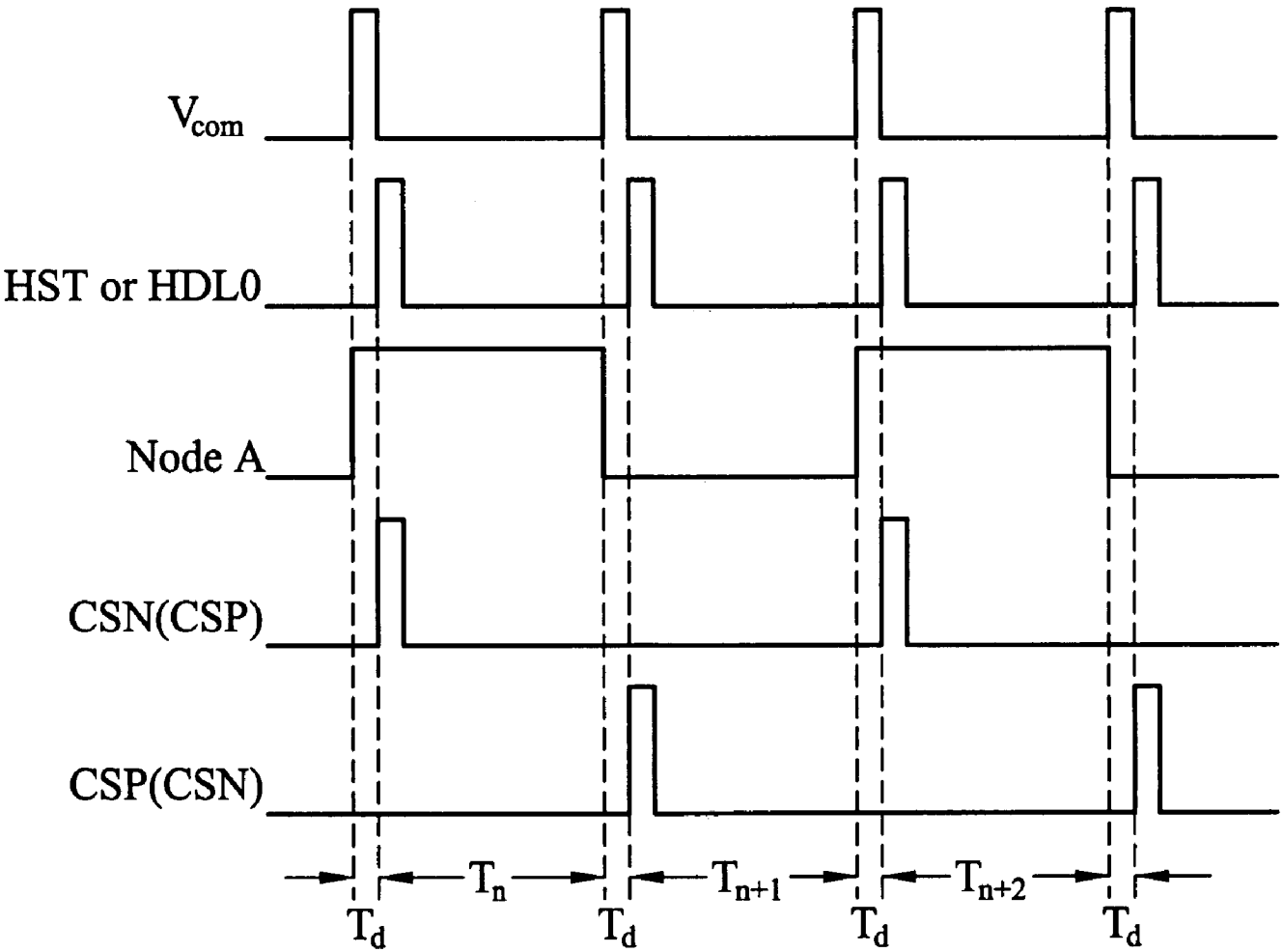
FIG. 12 is a plot showing a timing chart of the control circuit in FIG. 11.

FIG. 12 is a plot showing a timing chart of the control circuit in FIG. 11. During a period Tn, the common voltage signal Vcom is amplified by the level shifter 30. The selection terminal A is at a high voltage level, and the complementary selection terminal B is at a low voltage level. The transmission gate TG1 is turned on, and the transmission gate TG2 is turned off. After a time delay Td, the horizontal start signal HST and subsequent first driving signal HDL0 start to come out. The HST or HDL0 generates the positive precharge signal CSP. The thin film transistor TN2 is turned on and coupled to a low voltage level. Therefore, the negative precharge signal CSN does not function. During a period Tn+1, the common voltage signal Vcom is amplified by the level shifter 30. The selection terminal A is at a low voltage level, and the complementary selection terminal B is at a high voltage level. The transmission gate TG1 is turned off, and the transmission gate TG2 is turned on. The HST or HDL0 generates the negative precharge signal CSN. The thin film transistor TN1 is turned on and coupled to a low voltage level. Therefore, the positive precharge signal CSP does not function.

Fourth Embodiment

Figure 13:
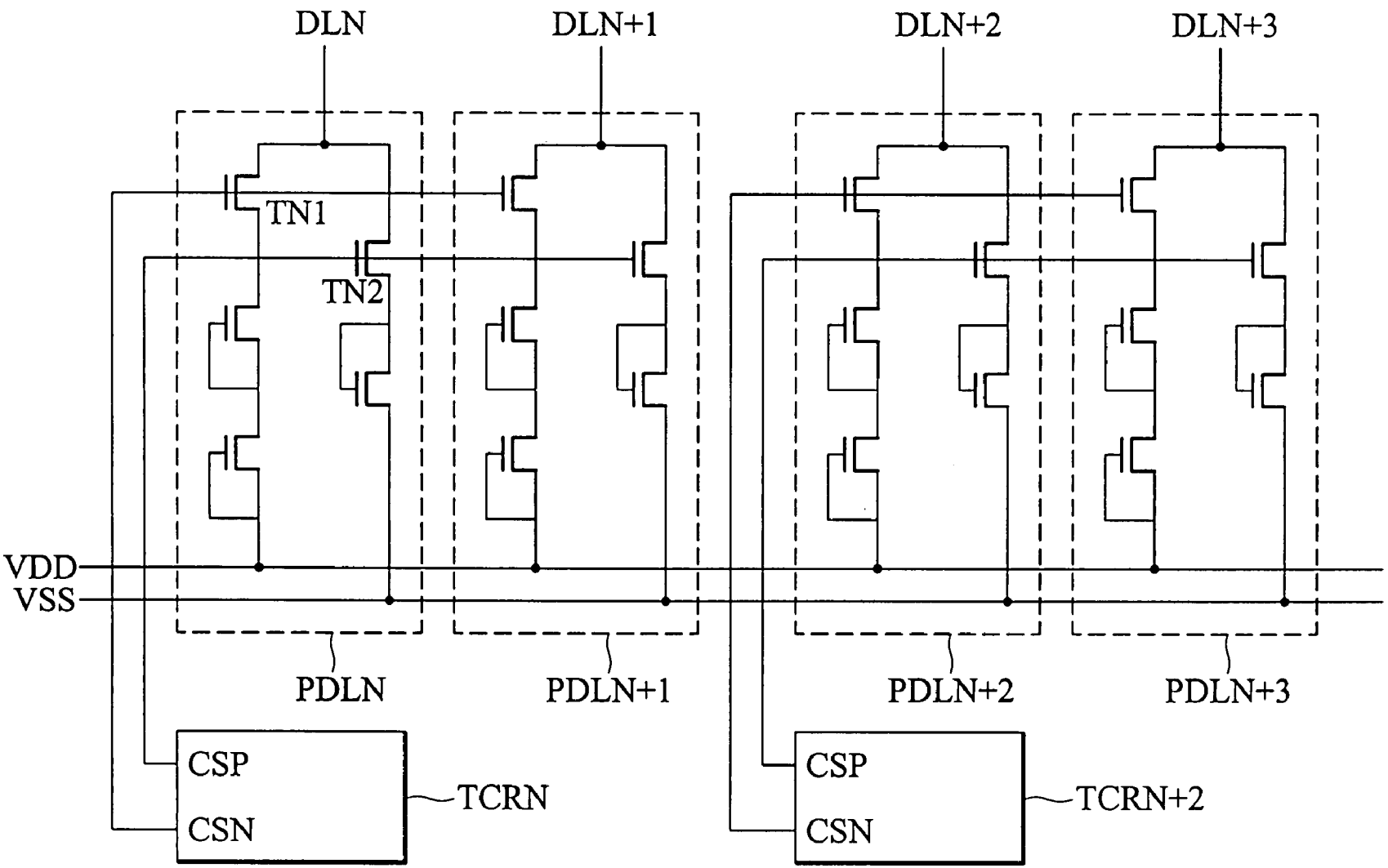
FIG. 13 is a schematic diagram showing a precharge array of the fourth embodiment of the present invention.

FIG. 13 is a schematic diagram showing a precharge array of the fourth embodiment of the present invention. As shown in FIG. 13, the precharge array comprises precharge circuits PDLN, PDLN+1, PDLN+2, and PDLN+3, data lines DLN, DLN+1, DLN+2, and DLN+3, and control signal generation circuits TCRN and TCRN+2. A high voltage source VDD and the low voltage source VSS are coupled to the data lines DLN, DLN+1, DLN+2, and DLN+3 respectively through the precharge circuits PDLN, PDLN+1, PDLN+2, and PDLN+3. Gate terminals of the thin film transistors TN1 in the precharge circuits PDLN and PDLN+1 are controlled by a negative precharge signal CSN generated from the control circuit TCRN, while gate terminals of the film transistors TN2 in the precharge circuits PDLN and PDLN+1 are controlled by a positive precharge signal CSP generated from the control signal generation circuit TCRN. Similarly, gate terminals of the thin film transistors TN1 in the precharge circuits PDLN+2and PDLN+3 are controlled by a negative precharge signal CSN generated from the control circuit TCRN+2, while gate terminals of the thin film transistors TN2 in the precharge circuits PDLN+2 and PDLN+3 are controlled by a positive precharge signal CSP generated from the control circuit TCRN+2. The control circuits TCRN and TCRN+2 can be implemented as the control signal generation circuit 250 in FIG. 9 or the control signal generation circuit 260 in FIG. 11.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A precharge system, appropriate for an active matrix display device having a plurality of data lines, a plurality of scan lines, a plurality of pixels, a first voltage source, and a second voltage source, comprising a precharge circuit having:

a plurality of first transistors, having gate electrode and drain electrode connected together to function as a diode, of which a first terminal is coupled to the first voltage source;

a second transistor of which a first terminal is coupled to the second terminals of the first transistors, of which a second terminal is coupled to the data lines, and a control terminal receives a positive precharge signal;

a plurality of third transistors, having gate electrode and drain electrode connected together to function as a diode, of which a first terminal is coupled to the second voltage source; and a fourth transistor of which a first terminal is coupled to the second terminals of the third transistors, of which a second terminal is coupled to the corresponding data lines, and a control terminal receives a negative precharge signal.

2. The precharge system as claimed in claim 1, wherein the first transistors are N-type thin film transistors.

3. The precharge system as claimed in claim 1, wherein the second transistor is an N-type thin film transistor.

4. The precharge system as claimed in claim 1, wherein the second transistor is a P-type thin film transistor.

5. The precharge system as claimed in claim 1, wherein the third transistors are N-type thin film transistors.

6. The precharge system as claimed in claim 1, wherein the third transistors are P-type thin film transistors.

7. The precharge system as claimed in claim 1, wherein the first transistors are P-type thin film transistors.

8. The precharge system as claimed in claim 1 further comprising a plurality of precharge circuits coupled to the corresponding data lines.

9. The precharge system as claimed in claim 8 further comprising a control signal generation circuit for generating the positive precharge signal and the negative precharge signal.

10. The precharge system as claimed in claim 9, wherein the control signal generation circuit comprises:

a selection circuit having an input terminal, a selection terminal, a complementary selection terminal, a first output terminal, and a second output terminal, wherein the input terminal receives a start impulse signal and the selection terminal and the complementary selection terminal enable the first output terminal or the second output terminal; and a voltage level shifter for receiving a clock signal and a complementary clock signal and for coupling the clock signal and the complementary clock signal respectively to the selection terminal and to the complementary selection terminal.

11. The precharge system as claimed in claim 9, wherein the control signal generation circuit comprises:

a selection circuit having an input terminal, a selection terminal, a complementary selection terminal, a first output terminal, and a second output terminal, wherein the input terminal receives a start impulse signal and wherein the selection terminal and the complementary selection terminal enable the first output terminal or the second output terminal; and a voltage level shifter for receiving the common voltage signal and coupling the amplified common voltage signal and the complementary amplified common voltage signal respectively to the selection terminal and to the complementary selection terminal.

an inverter of which an input terminal is coupled to the output terminal of the voltage level shifter and an output terminal is coupled to the complementary selection terminal.

12. The precharge system as claimed in claim 11, wherein the selection circuit comprises:

a first transmission gate having a first terminal and a second terminal, wherein the first terminal is coupled to the input terminal and wherein a first gate of the second terminal is coupled to the selection terminal, and a second gate of the second terminal is coupled to the complementary selection terminal;

a third transistor having a first terminal coupled to the second terminal of the first transmission gate, having a second terminal coupled to a low voltage source, and having a control terminal coupled to the selection terminal;

a second transmission gate having a first terminal and a second terminal, wherein the first terminal is coupled to the input terminal and wherein a first gate of the second terminal is coupled to the complementary selection terminal, and a second gate of the second terminal is coupled to the selection terminal; and a fourth transistor having a first terminal coupled to the second terminal of the second transmission gate, having a second terminal coupled to the low voltage source, and having a control terminal coupled to the complementary selection terminal.

13. The precharge system as claimed in claim 8 further comprising a plurality of control signal generation circuits for respectively generating the positive precharge signal and the negative precharge signal and for coupling the positive precharge signal and the negative precharge signal to the corresponding precharge circuits.

* * * * *